US010780003B2

(12) United States Patent
Beyer et al.

(10) Patent No.: US 10,780,003 B2
(45) Date of Patent: Sep. 22, 2020

(54) ADJUSTABLE ERGONOMIC CHAIR

(71) Applicant: Haworth, Inc., Holland, MI (US)

(72) Inventors: Peter J. Beyer, Hamilton, MI (US); Kyle R. Fleet, Zeeland, MI (US); Teresa A. Bellingar, Holland, MI (US)

(73) Assignee: Haworth, Inc., Holland, MI (US)

( * ) Notice: Subject to any disclaimer, the term of this patent is extended or adjusted under 35 U.S.C. 154(b) by 76 days.

(21) Appl. No.: 16/240,073

(22) Filed: Jan. 4, 2019

(65) Prior Publication Data

US 2020/0214916 A1 Jul. 9, 2020

(51) Int. Cl.

| | |
|---|---|
| ***A61G 5/10*** | (2006.01) |
| ***A47C 3/20*** | (2006.01) |
| ***A61G 5/12*** | (2006.01) |
| ***A47C 7/02*** | (2006.01) |

(52) U.S. Cl.

CPC ..... *A61G 5/1067* (2013.01); *A47C 3/20* (2013.01); *A47C 7/024* (2013.01); *A61G 5/1059* (2013.01); *A61G 5/1075* (2013.01); *A61G 5/122* (2016.11)

(58) Field of Classification Search

None

See application file for complete search history.

(56) References Cited

U.S. PATENT DOCUMENTS

| | | | |
|---|---|---|---|
| X430952 | | 6/1890 | Hill |
| 453,914 | A | 6/1891 | Ramsey |
| 1,180,637 | A | 4/1916 | Emanuel |
| 2,122,935 | A | 7/1938 | Fleischer |
| 2,650,648 | A | 9/1953 | Nordmark |
| 2,703,136 | A | 3/1955 | Masse |
| 2,788,846 | A | 4/1957 | Hauser |
| 4,366,981 | A | 1/1983 | Ziegler et al. |
| 4,938,533 | A | 7/1990 | Thielois |
| 5,261,723 | A | 11/1993 | Hosoe |
| 5,435,623 | A | 7/1995 | Kapec et al. |

(Continued)

FOREIGN PATENT DOCUMENTS

| | | |
|---|---|---|
| DE | 4212943 | 10/1993 |
| DE | 102009023398 | 12/2010 |

(Continued)

OTHER PUBLICATIONS

Kinema Active Chair Press Release, Oct. 2014, http://kinemaproducts.com/141109 kinema-active-chair press-release.pdf.

*Primary Examiner* — David E Allred

(74) *Attorney, Agent, or Firm* — Warner Norcross + Judd LLP

(57) ABSTRACT

An office-type chair includes a base, a height-adjustable pedestal extending upward from the base, a seat assembly including a rear seat part and a front seat part, and a linkage system connecting the pedestal to the seat assembly. The linkage system is adapted to pivot the seat assembly between a lowered position to serve as a task chair and an elevated position to serve as an elevated sitting support. A backrest arrangement may extend from the seat assembly. In the lowered position, the front and rear seat parts are both generally horizontally oriented. In the elevated position, the rear seat part may have a slight forward tilt and be positioned higher than in the lowered position, and the front seat part may extend at a downward angle relative to the rear seat part.

20 Claims, 14 Drawing Sheets

(56) References Cited

U.S. PATENT DOCUMENTS

| | | | | |
|---|---|---|---|---|
| 5,447,358 | A | 9/1995 | Corlett | |
| 5,560,448 | A * | 10/1996 | Yemini | B25H 1/06 182/153 |
| 5,630,648 | A | 5/1997 | Allard et al. | |
| 5,984,411 | A * | 11/1999 | Galumbeck | A47C 9/005 297/344.15 |
| 6,286,901 | B1 | 9/2001 | Ritch | |
| 6,752,459 | B2 | 6/2004 | Deisig | |
| 7,195,316 | B2 | 3/2007 | Shimasaki et al. | |
| 7,219,956 | B2 | 5/2007 | Zhang | |
| 7,246,683 | B2 | 7/2007 | Pringnitz | |
| 7,252,336 | B2 | 8/2007 | Frisina | |
| 7,275,788 | B2 | 10/2007 | Dettmann et al. | |
| 7,293,825 | B2 | 11/2007 | Vergara et al. | |
| 7,540,565 | B2 * | 6/2009 | Lipford | A61G 5/14 297/284.3 |
| 7,827,921 | B2 | 11/2010 | Shields | |
| 8,220,872 | B2 | 7/2012 | Hong | |
| 9,492,339 | B2 * | 11/2016 | Leib | A61G 5/14 |
| 2003/0038518 | A1 * | 2/2003 | Williams | B66F 7/0641 297/330 |
| 2003/0151288 | A1 * | 8/2003 | Deisig | A47C 3/20 297/313 |
| 2004/0227386 | A1 | 11/2004 | Tsujibayashi | |
| 2005/0127740 | A1 | 6/2005 | Dowty | |
| 2005/0140193 | A1 | 6/2005 | Skelly | |
| 2007/0200414 | A1 | 8/2007 | Pozzi | |
| 2007/0290538 | A1 | 12/2007 | Walter | |
| 2011/0121626 | A1 * | 5/2011 | Lipford | A61G 5/14 297/330 |
| 2012/0007341 | A1 * | 1/2012 | Masaki | A61G 5/0825 280/650 |
| 2012/0319444 | A1 | 12/2012 | Onopa | |
| 2013/0169017 | A1 | 7/2013 | Masunaga et al. | |
| 2014/0042780 | A1 | 2/2014 | Warncke | |
| 2015/0076876 | A1 | 3/2015 | Hasegawa | |
| 2015/0282623 | A1 | 10/2015 | Reddig | |

FOREIGN PATENT DOCUMENTS

| | | | | |
|---|---|---|---|---|
| FR | 2779621 | | 12/1992 | |
| FR | 2718620 | | 10/1995 | |
| TW | 200808584 | | 2/2008 | |
| WO | WO-2006047142 | A2 * | 5/2006 | A47C 3/021 |
| WO | 2007141054 | | 12/2007 | |

* cited by examiner

ADJUSTABLE ERGONOMIC CHAIR

BACKGROUND OF THE INVENTION

The present invention relates to chairs, and more particularly to a chair configured to provide ergonomic sitting posture support at an elevated ergonomic position, and adjustment between a standard upright posture and the elevated ergonomic position.

Various designs for office chairs have been developed, offering ergonomic improvements to individuals who spend much of their workday at a desk. Generally, office chairs are designed to support an individual in an upright seated posture with the ability to recline the seat back or to adjust the angle of the seat pan forward of horizontal (known as "forward tilt") or to otherwise adjust the angle of the seat pan to the individual's preference. Most office chairs also include a height adjustment for moving the seat portion of the chair up and down so as to accommodate individuals of different heights and sizes and/or the height of the desk being utilized.

Stools, perch-style stools and chairs and other chairs that have a wide range of height adjustability have been used to give a user the ability to work in either a sitting or a standing posture. Stools, perch-style stools and chairs provide the individual with the option of an elevated sit when using a height adjustable table, but they also suffer from numerous drawbacks. First, there are stability concerns with stools and perch-style stools and chairs in a raised position, often requiring complex caster locking mechanisms, weighted bases, and restricted recline. Second, there are ergonomic concerns with stools, such as the need for an individual to rest their feet on a footring for support, which results in an angle between the thigh and the calf of less than 90 degrees and can restrict blood flow.

Noting the disadvantages of stools and perch-style stools and chairs, workers are left with the option of fully sitting or standing at their work surfaces. Both of these postures are classified as "static" postures, where the muscle tenses but does not move (as opposed to a dynamic posture where muscle tension is accompanied by movement). Static work postures are known to produce fatigue, for example, because when muscles exert force in a fixed posture, there is reduction in the blood supply to that muscle.

In contrast to static postures, dynamic postures, which include motion while in a seated posture or motion in between postures, promote proper blood flow and insure the proper maintenance of various healthy biological functions. Movement contributes to blood circulating through the muscles. In addition, movement is ergonomically beneficial to the spine because spinal motion over a period of time changes the loads on the spine, providing spinal nourishment. Loading and unloading the spine allows fluid to be pumped into and out of the discs by osmosis, thus improving the nutritional support to the discs. Lack of movement—such as from static postures—will eventually cause muscle fatigue within the lower vertebrae which may result in discomfort.

The promotion of "neutral" seating postures can also reduce both stress and moderate pressures on the body to provide a comfortable working experience for prolonged periods of time. Each body joint has a neutral posture which relates to its alignment with respect to other parts of the body where musculoskeletal stress for that joint is minimized and its strength is maximized. The minimization of stress on a joint increases the comfort of the body in that posture. A change in any of the joints from its neutral posture will, however, reduce the strength for that body part, sometimes significantly, as well as potentially reduce the comfort of the body in the new posture.

For the spine specifically, a neutral posture means that all three regions (cervical, thoracic and lumbar) are in alignment. That being said, the shape of the spine is based on the orientation of the pelvis. A neutral position of the pelvis allows for the ideal alignment for both the pelvis and the spine—specifically the low back or lumbar region. As the orientation of the pelvis changes, so does the curvature of the lumbar. Thus, as the pelvis rotates posteriorly to allow an individual to sit in the traditional fixed 90 to 100-degree upright posture, the natural lordotic curvature of the spine flattens and can potentially take on reverse spinal curvature known as kyphosis. If a person has limited hip flexion, they may also compensate by further flexing their lumbar spine. When the lumbar spine is in this kyphotic state, it unevenly compresses the discs of the lumbar spine (and may even cause posterior protrusion of the lumbar intervertebral discs) and this subsequent spinal compression can cause both back and leg pain.

When sitting with the spine in its neutral posture, in general, the center of mass of the person is directly above the ischial tuberosities for individuals in the normal BMI range. In traditional upright seated postures, approximately 70-75% of the occupant's weight is supported by the seat cushion. This results in a level of pressure at the interface of the thighs and buttocks with the seat in excess of 2.25 psi, causing capillary inclusion. A sedentary posture causes limited blood perfusion and often results in fidgeting or the desire to intermittently shift weight. If the pelvis rotates anteriorly, the weight of the person shifts forward resulting in more of their weight being supported by the legs.

Early research has shown that a generally neutral position of the lumbar spine where balanced muscle relaxation occurs is at an angle of between about 121 and 135 degrees between the torso and the thigh. Most current chairs are designed to support the occupant in an upright posture at an approximate 98-100 degree inclusive thigh to torso angle. Beyond this, these chairs can provide some level of additional backrest recline, increasing the thigh to torso angle to 120 degrees, but only in a more recumbent posture. Although this recline action induces motion in the occupant which is perceived as beneficial to the body by increasing the thigh to torso angle, it does so by pulling the occupant away from their desk and does not easily facilitate a continued workflow. Some research has also shown that in the reclined position the weight of the abdomen can also cause a decrease in the curvature (flattening) of the lumbar spine even though the expectation would be that the opening of the torso to thigh angle it would actually increase lumbar curvature.

Referring now to FIG. 14, the alignment of the pelvis in relation to the spine also bears importance. When a person is in a neutral posture, the posterior superior iliac spine (PSIS) 104 is located slightly higher than the anterior superior iliac spine (ASIS) 106. In a standing posture, which is known as a neutral posture (albeit with the disadvantage of all weight being on the user's legs and feet) there is an average downward inclination of the pelvis (also referred to as the pelvic angle 108) of about 9.9 degrees as measured in the sagittal (as shown, horizontal) plane 110. As the pelvis rotates posteriorly when moved to a sitting posture, the relationship between the PSIS and the ASIS changes, with the ASIS becoming in line with it or potentially even being higher than the PSIS.

To summarize, research has shown that an increase in dynamic posture, as well as an increase in the amount of time a user spends in a more neutral posture, can contribute to less musculoskeletal stress on the user resulting in less fatigue and a more ergonomic user experience. A more neutral posture is experienced when the thigh to torso angle is between about 121 and 135 degrees and the pelvic angle is such that the posterior superior iliac spine (PSIS) is located higher than the anterior superior iliac spine (ASIS) (but not so much higher that the pelvis would no longer be considered to be in a neutral posture). Manufacturers with an understanding of proper ergonomics continue to develop seating approaches that encourage and maximize these healthy and ergonomic postures.

SUMMARY OF THE INVENTION

The present invention provides an office-type chair that provides adjustment between a standard upright posture and an ergonomic elevated position. It additionally promotes activity and dynamic movement in the transition from one posture to the other.

In one embodiment, the chair includes a base, a height-adjustable pedestal extending upward from the base, a seat assembly including a rear seat part and a front seat part, and a linkage system connecting the pedestal to the seat assembly. The linkage system is adapted to pivot the seat assembly between a first generally horizontal position to serve as a task chair and a second more upward and forwardly angled position to serve as an elevated sitting support. The chair may additionally include a task-chair-style backrest arrangement including a recline mechanism and backrest support, the backrest support extending upwardly from the seat assembly for supporting the back of a user in the first and second positions, wherein the recline mechanism is connected to the rear part of the seat assembly and the backrest support rotates with respect to the recline mechanism.

In one embodiment, in the lowered position of the seat assembly, the front and rear seat parts are both generally horizontally oriented such that they are in line with each other. When the chair is in the elevated position, the rear seat part may have a slight forward tilt and be positioned higher than in the lowered position, and the front seat part may extend at a downward angle relative to the rear seat part. In this elevated position, the forward tilt of the rear seat part promotes forward rotation of the user's pelvis, and combination of the rear seat part's forward tilt with the downward angle of the front seat part reduces stress on the user's thighs and promotes opening of the thigh-torso angle to a neutral posture.

The rear seat part of the chair may include a concave portion forming an ischial tuberosity pocket that acts to retain and support the user even as the rear seat part is tilted slightly forward. In the elevated position, the ischial tuberosity pocket is approximately vertically in line with the center of the height adjustable pedestal to provide stability to a user sitting on the rear seat part. The chair may also include a bridge between the front seat part and the rear seat part formed by an interlacing arrangement of finger like projections that are capable of sliding relative to each other. The bridge may be positioned a distance approximately 6" forward of the occupant's ischial tuberosity bones.

In one embodiment, the base includes multiple support arms with non-locking casters. In some instances, these casters may include properties that prevent an unoccupied chair from inadvertently repositioning as the chair is articulated between the lowered and the elevated posture positions. As discussed in more detail below, the arrangement of the seat assembly in the elevated ergonomic position provides sufficient support to a user that, along with the support of the user's feet on the ground, locking casters are not necessary for use. Movement of the seat to the elevated position may require the user to stand up with the chair—in a dynamic posture—with a natural pivot at the ankle joint and without substantial movement of the casters.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and may be practiced or may be carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

Figure 1:
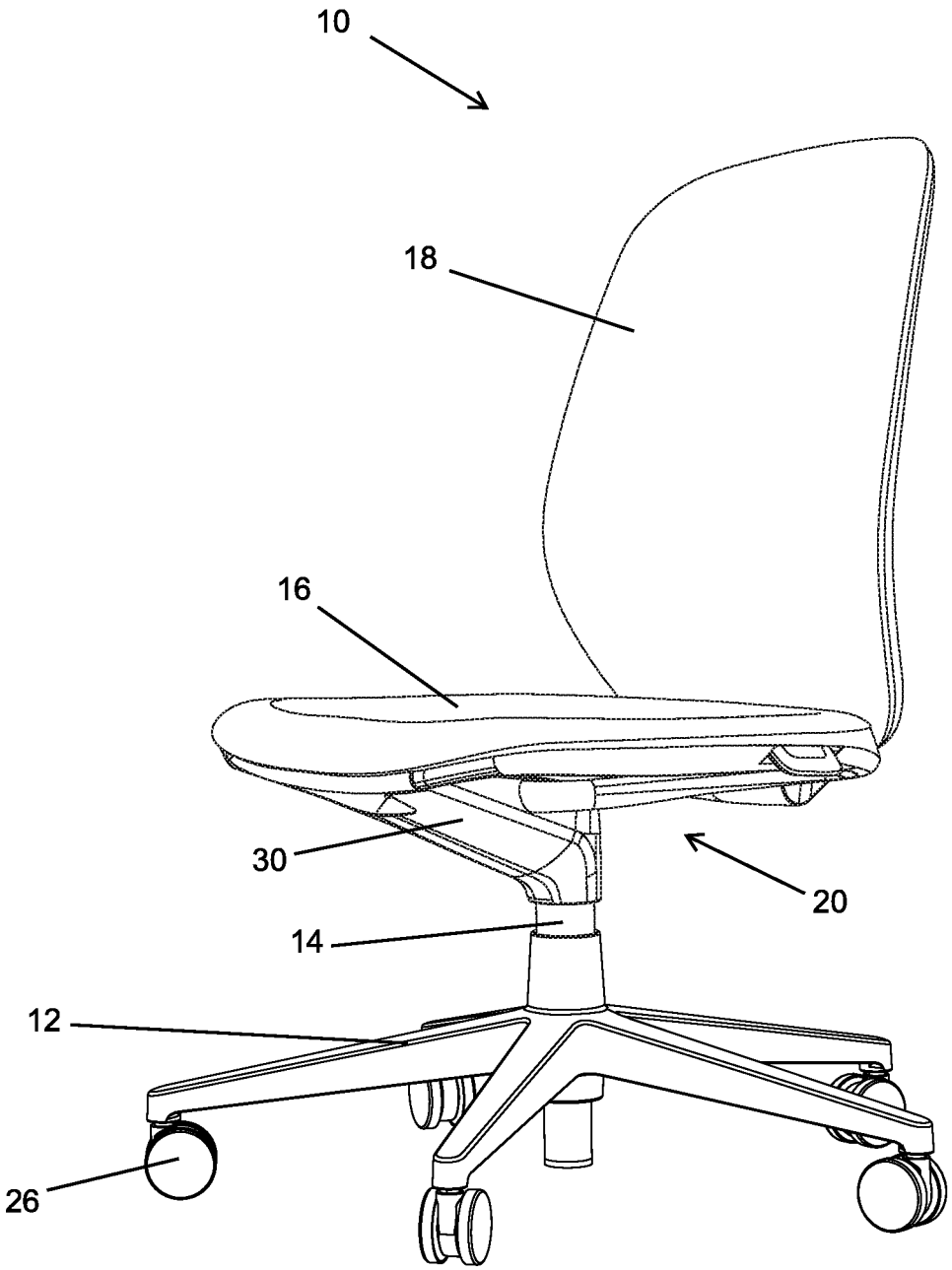
FIG. 1 is a front perspective view of a chair according to one embodiment of the present invention.
Figure 2:
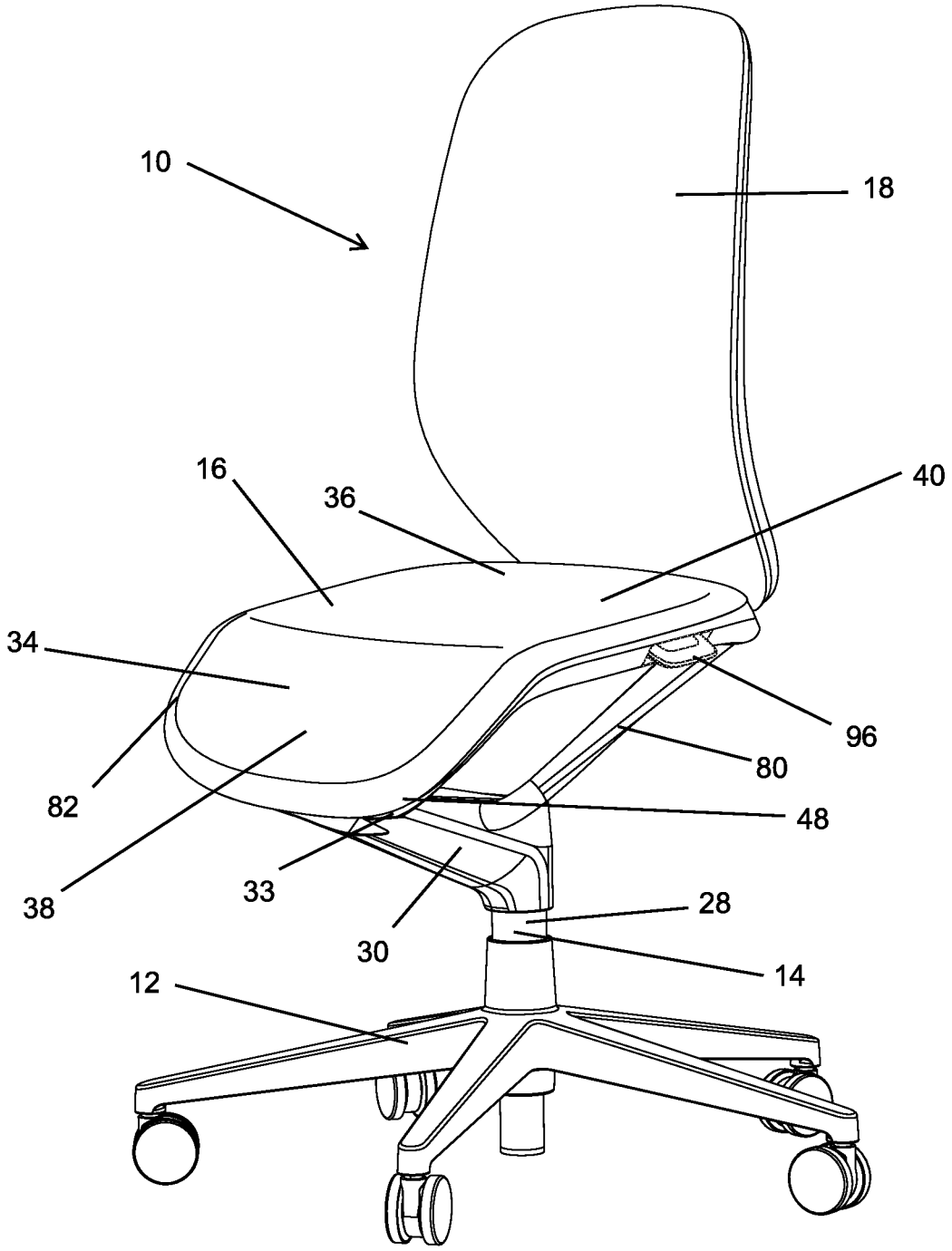
FIG. 2 is a front perspective view of the chair in an elevated ergonomic position.

Referring to the Figures, an office-type chair is shown in accordance with one embodiment of the present invention and generally designated 10. The chair 10 includes a base 12, a pedestal 14 extending upwardly from the base 12, a seat assembly 16 supported on the pedestal 14, and a backrest 18 extending upwardly from the seat assembly 16. A linkage mechanism 20 operatively connects the seat assembly 16 to the pedestal 14 or the base 12 and enables movement of the seat assembly 16 from a lowered, generally horizontal position to an elevated ergonomic position that is described in more detail below.

The base 12 forms the ground engaging surface for the office-type chair 10. In one embodiment, the base 12 includes a cylindrical hub 22 and a series of five support arms 24 extending radially outwardly from the hub 22 (although other types and a different amount of supports are also possible). The support arms 24 may each include a caster 26, which in one embodiment may be non-locking casters 26. Non-locking casters may include standard non-locking casters and casters which limit the speed or amount of roll and may help prevent inadvertent repositioning or rolling away of the chair 10, for example, when a user sits on the chair in either the lowered or the elevated posture positions. In another embodiment, not shown, the casters 26 may be selectively lockable such that the user can lock the casters to prevent them from rolling and thus prevent movement of the chair 10 along the ground surface.

The pedestal 14 extends upwardly from the base 12. In the illustrated embodiment, the pedestal 14 includes a lower portion 28 and an upper portion 30 fixed to the lower portion 28. The lower portion 28 is generally cylindrical, and is sized to fit within the hub 22 of the base 12. The hub 22 may include a generally conventional height adjustment mechanism that can be actuated by the user to raise and lower the pedestal 14, and thus raise and lower the height of the seat assembly 16 with respect to the ground surface, by sliding the lower portion 28 of the pedestal 14 within the hub 22. In one embodiment, an activation lever 27 is connected to the height adjustment mechanism such that a user can activate the height adjustment mechanism by pulling the lever 27. The lower portion 28 may also be capable of rotating within the hub 22 to enable swiveling rotation of the seat assembly 16. In the illustrated embodiment, the upper portion 30 of the pedestal 14 is fixed to the lower portion 28 but extends at an angle from the upper end 32 of the lower portion 28. More particularly, in the illustrated embodiment, the upper portion 30 extends upwardly at about a 30 degree angle from the generally vertical lower portion 28, and the upper portion 30 extends forwardly toward the forward edge of the seat assembly, as described in more detail below. The upper portion 30 thus acts as a support for the seat assembly 16 and linkage mechanism 20. In the illustrated embodiment, the upper portion 30 is Y-shaped, extending from a narrow first end 31 and widening to a second end 33 that forms a yolk having first 35 and second 37 arms.

Figure 3:
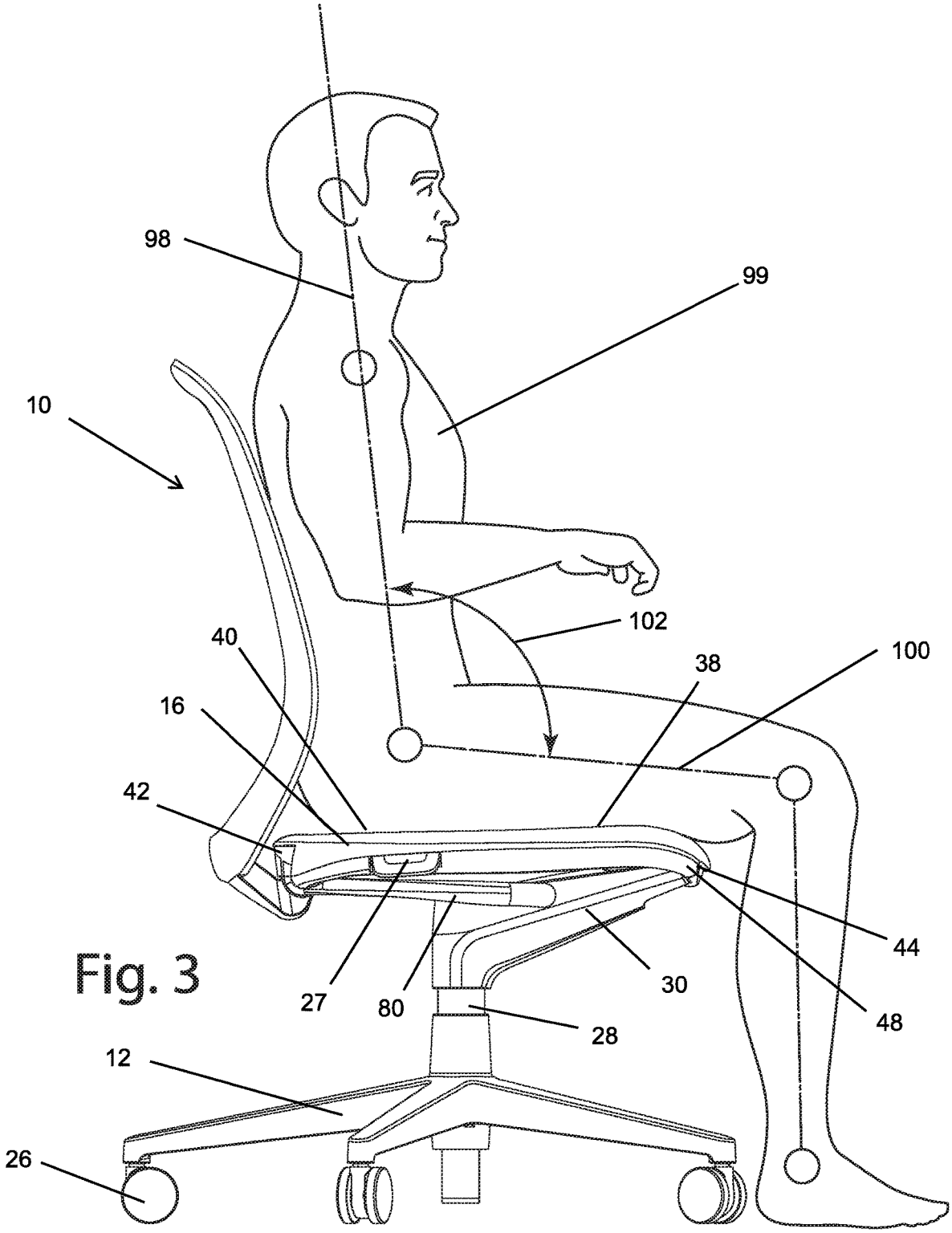
FIG. 3 is a side view of the chair according to one embodiment.
Figure 4:
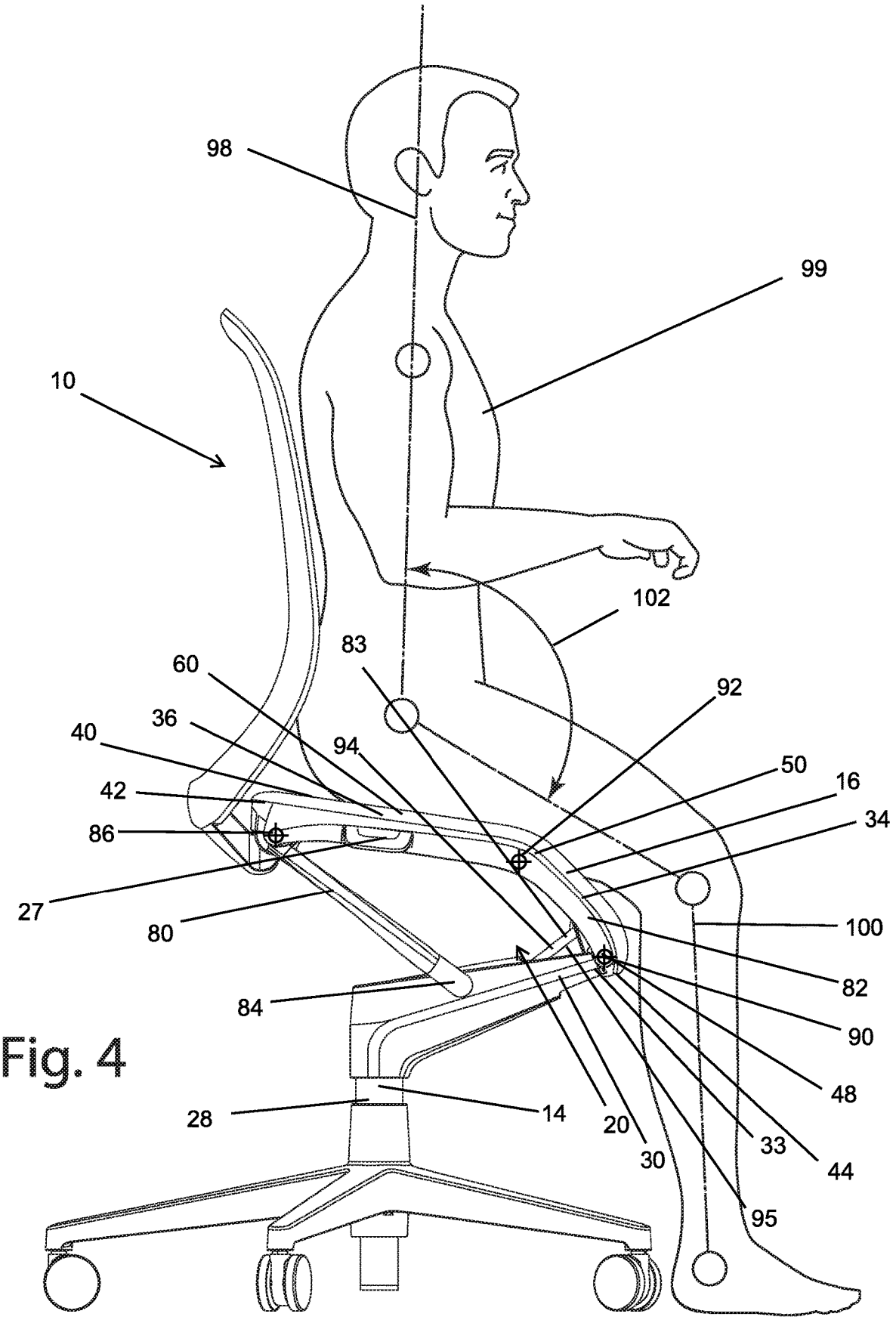
FIG. 4 is a side view of the chair in the elevated ergonomic position.
Figure 5:
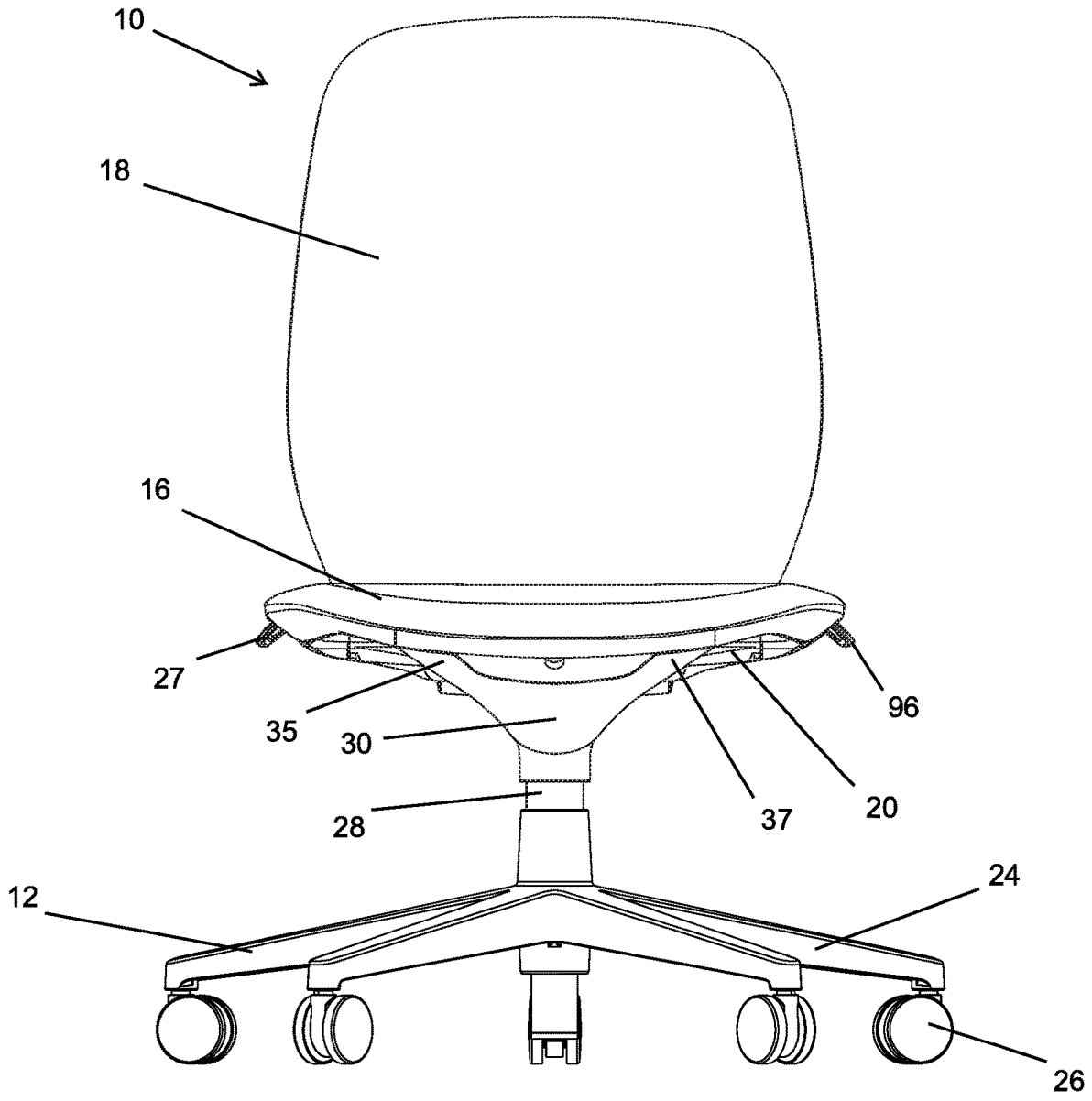
FIG. 5 is a front view of the chair according to one embodiment.
Figure 6:
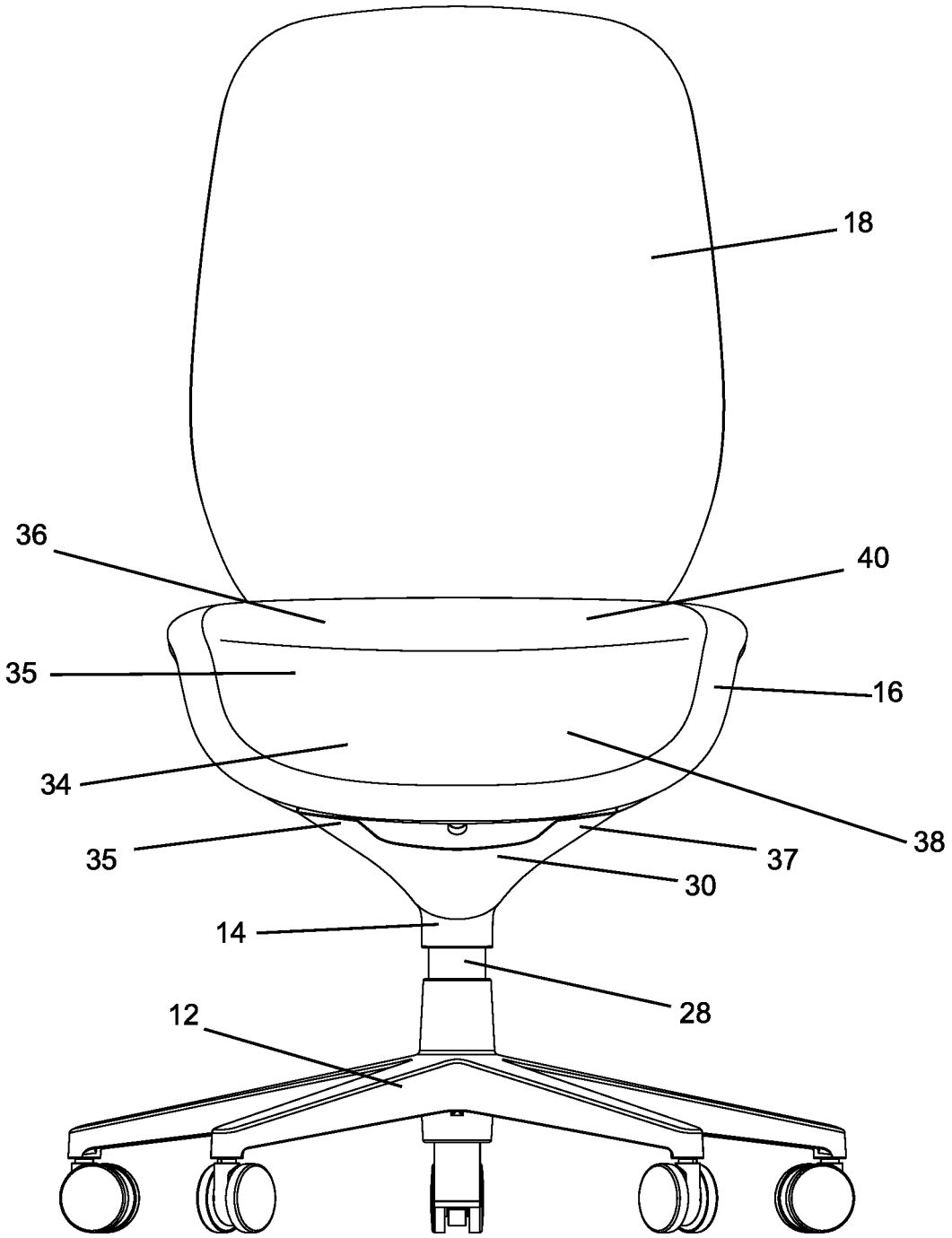
FIG. 6 is a front view of the chair in the elevated ergonomic position.
Figure 7:
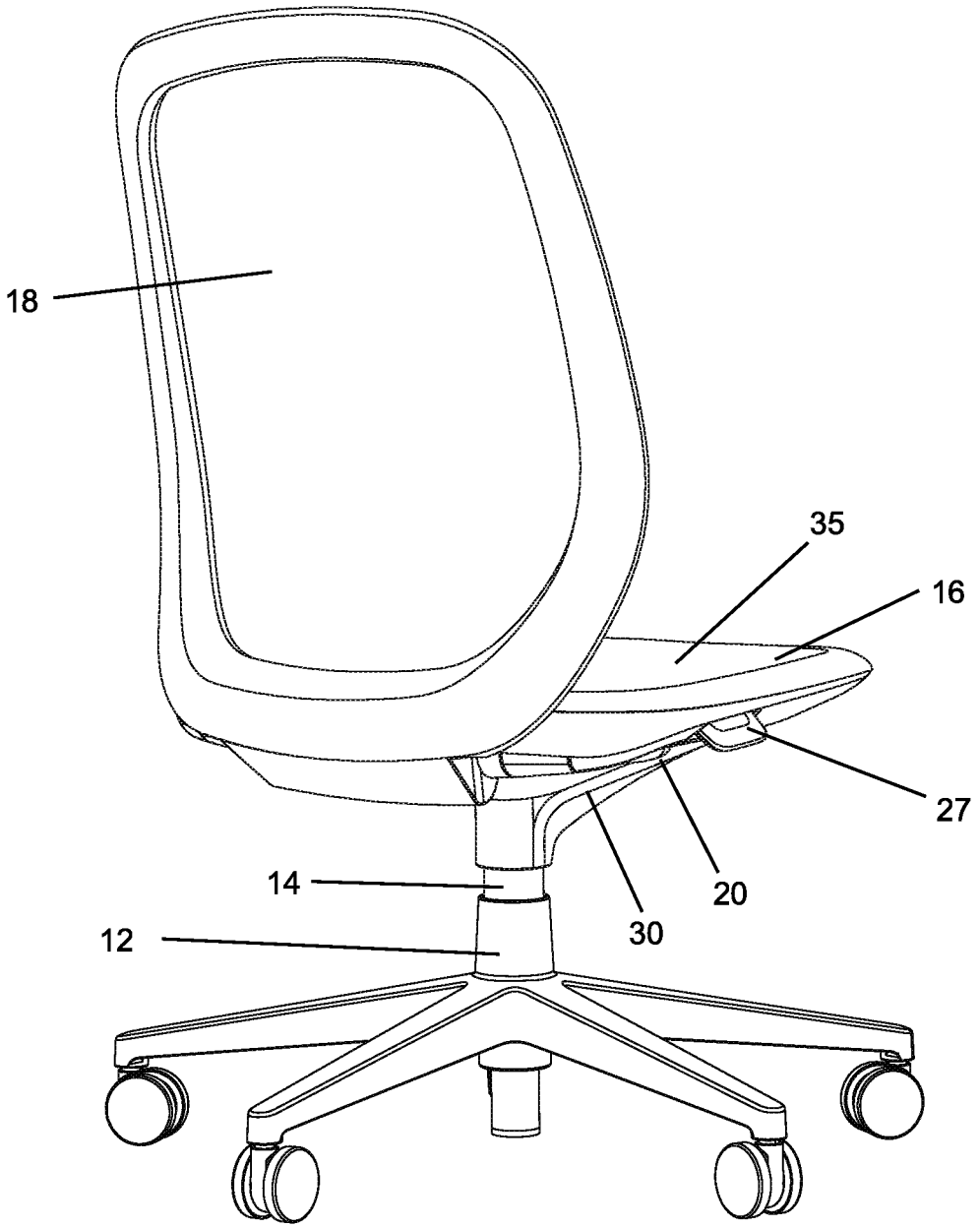
FIG. 7 is a rear perspective view of the chair according to one embodiment.
Figure 8:
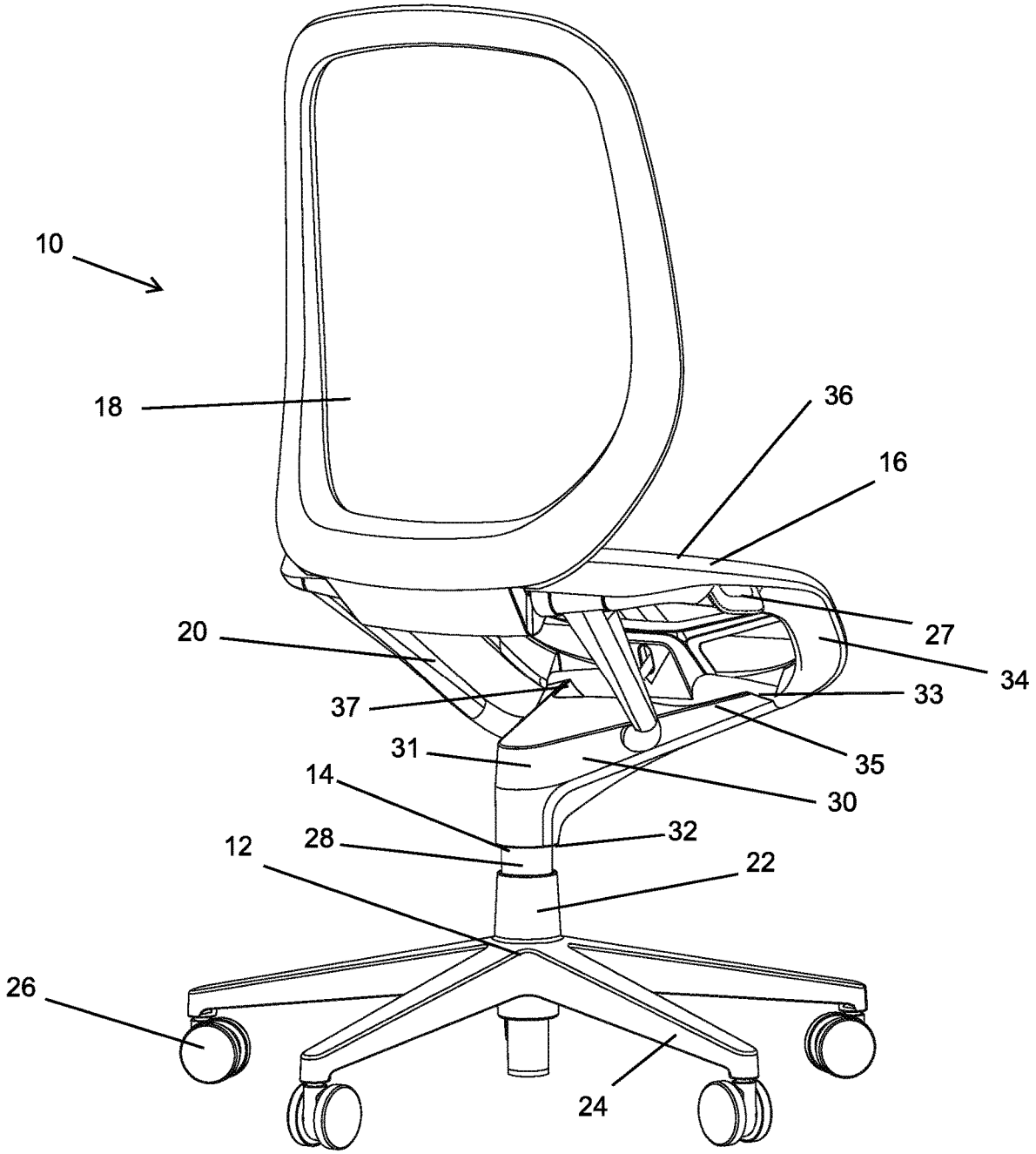
FIG. 8 is a rear perspective view of the chair in the elevated ergonomic position.
Figure 9:
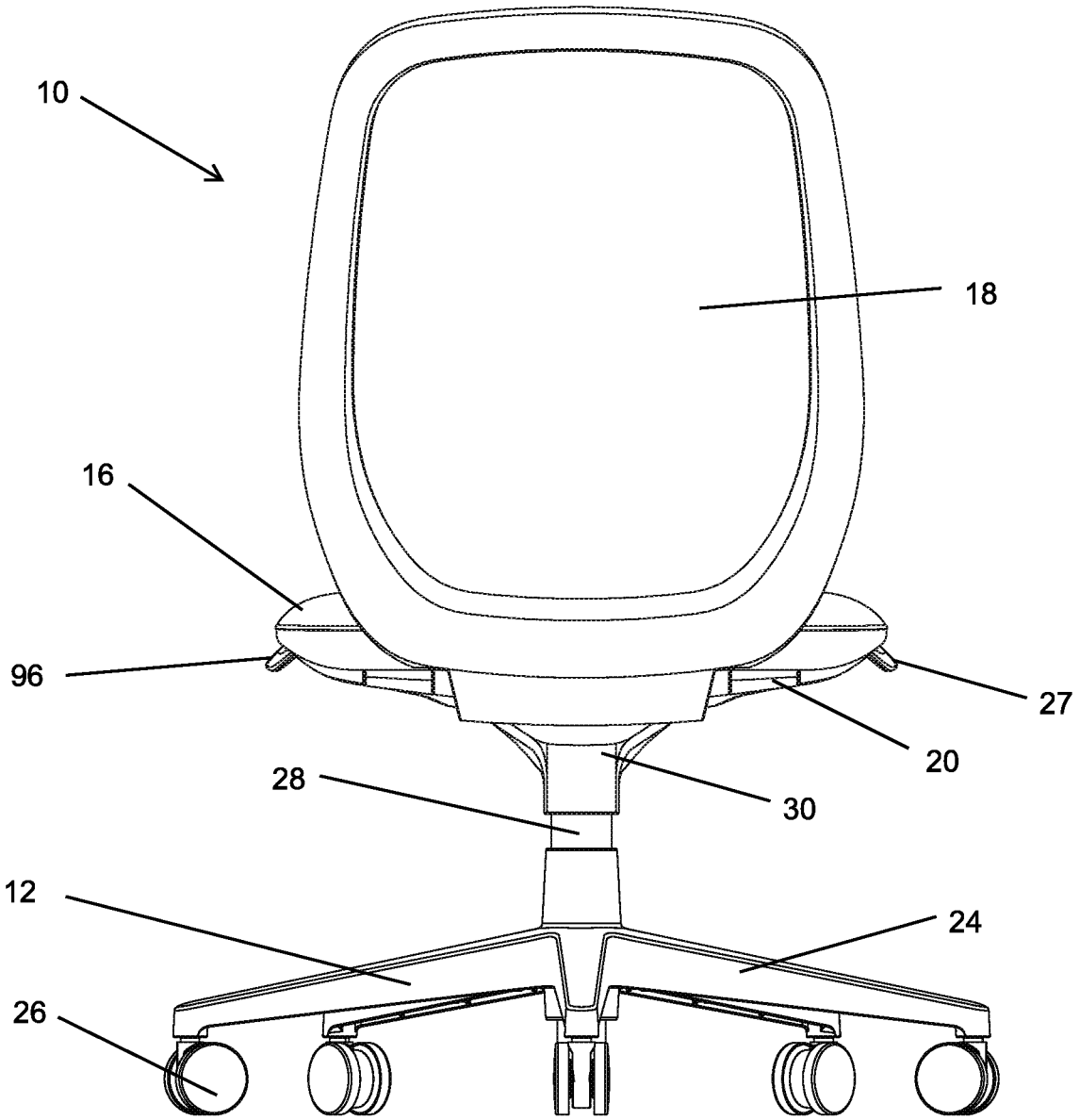
FIG. 9 is a rear view of the chair according to one embodiment.
Figure 10:
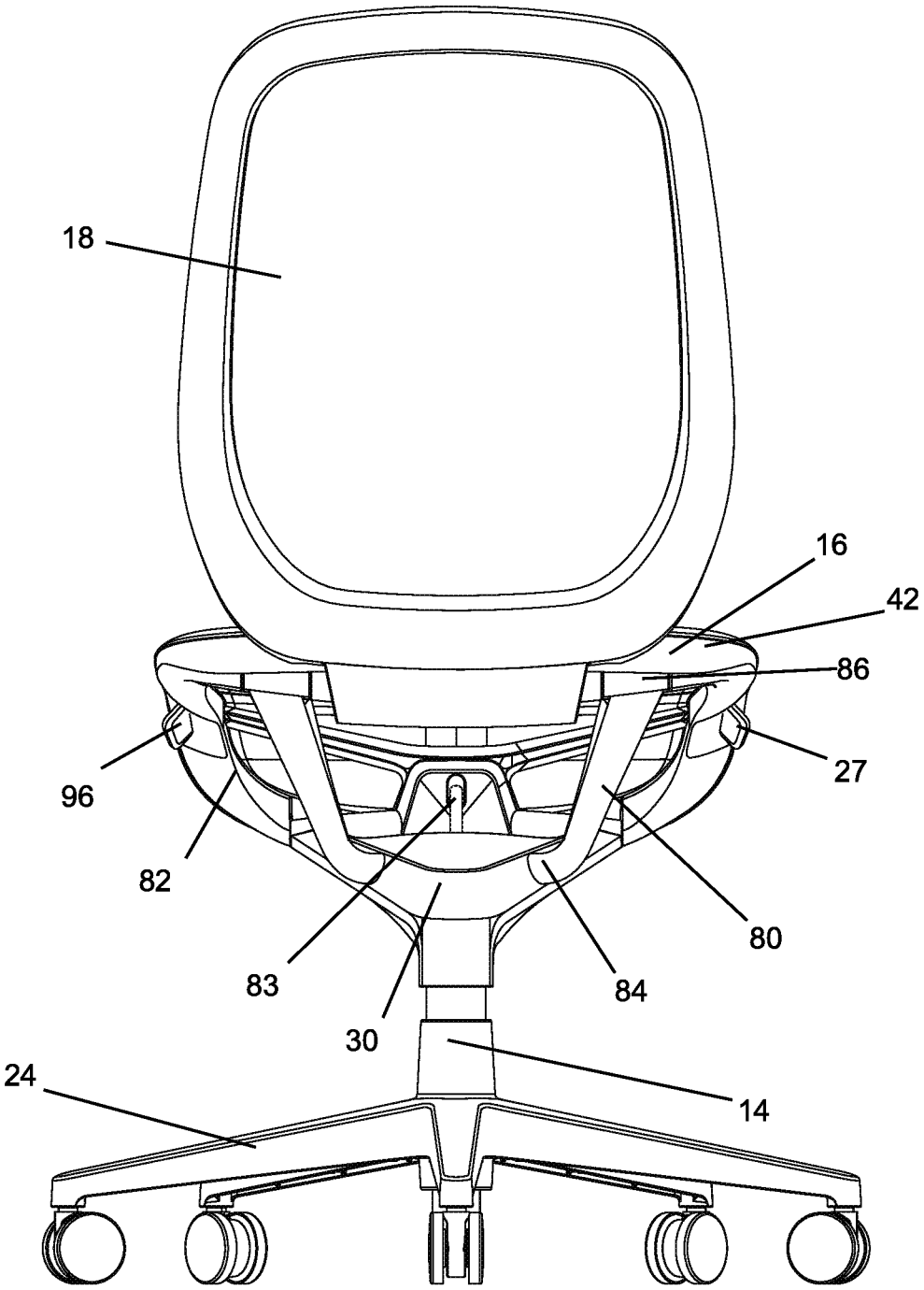
FIG. 10 is a rear view of the chair in the elevated ergonomic position.

The seat assembly 16 is supported above the pedestal 14 and can be moved between a lowered, generally horizontal position as shown in FIG. 3 and an elevated ergonomic position as shown in FIG. 4. In one embodiment, the seat assembly 16 includes a front portion 34 and a rear portion 36. The seat assembly 16 includes a cushioned upholstery 35 extending continuously over both the front 34 and rear 36 portions. The upholstery 35 on the front 34 includes an upper surface 38 and the upholstery 35 on the rear portion 36 includes an upper surface 40. The front 34 and rear 36 portions are capable of pivoting with respect to one another, and as shown in the illustrated embodiment, the front portion 34 is capable of pivoting downwardly with respect to the rear portion 36. As described in more detail below, the front portion 34 pivots downward with respect to the rear portion when the seat assembly 16 is raised to the upper elevated position as shown in FIGS. 2, 4, 6, 8, 20 and 12. In the lowered position, such as that shown in FIGS. 1, 3, 5, 7, 9, and 11, the upper surfaces 38, 40 of the front 34 and rear 36 portions are generally aligned in a common plane. As shown in FIG. 3, this plane may be tilted slightly rearwardly from horizontal, such as about 3.5 degrees rearward of horizontal, with a rear edge 42 of the rear portion 36 thus slightly lower than a front edge 44 of the front portion 36. In another embodiment, the tilt angle of the seat assembly may be different, such as slightly greater or less than 3.5 degrees rearward tilt, or even true horizontal or a slightly forward tilt.

Referring now to FIGS. 2, 4, 6, 8 and 10, when the seat assembly 16 is in the ergonomic elevated position, both portions of the seat assembly 16 may be raised from their lowered positions, and the front portion 34 is tilted downwardly with respect to the rear portion 36. In one embodiment, the rear portion 36 is raised between about 4 and 8 inches from its lowered position, and in a more particular embodiment the rear portion is raised about 5 inches from its lowered position and generally aligned above the lower portion 28 of the pedestal 14. Additionally, the rear portion 36 tilts forward with respect to its lowered position. In one embodiment, the rear portion of the seat experiences about an 8.5 degree change in its tilt angle when it is moved from the lowered to the elevated position. In one embodiment, the rear portion 36 is tilted about 5 degrees forward with respect to horizontal when the seat assembly is in the elevated position, such that the rear portion 36 experiences about an 8.5 degree change in tilt angle from the lowered position in which it is slightly rearwardly tilted at about 3.5 degrees to the elevated position in which it is tilted about 5 degrees forward.

The movement of the front portion 34 is different from that of the rear portion 36 when moving to the elevated position in a manner that is predetermined to promote a neutral posture. In one embodiment, when the seat assembly 16 is moved to the elevated position, the motion of the front portion 34 is such that it generally pivots about an axis 48 extending laterally through the front edge 44 of the front portion 34. A rear edge 50 of the front portion is raised from its lowered position. As such, in the elevated position, the front portion 34 is angled downwardly from the rear portion 36. In one embodiment, this angle between front 34 and rear 36 portions is set at about 40 degrees such that the front portion 34 drops off from the rear portion 36 to relieve stress on the user's thigh and promote an ergonomic posture by enabling opening of the user's thigh-torso angle.

Figure 11:
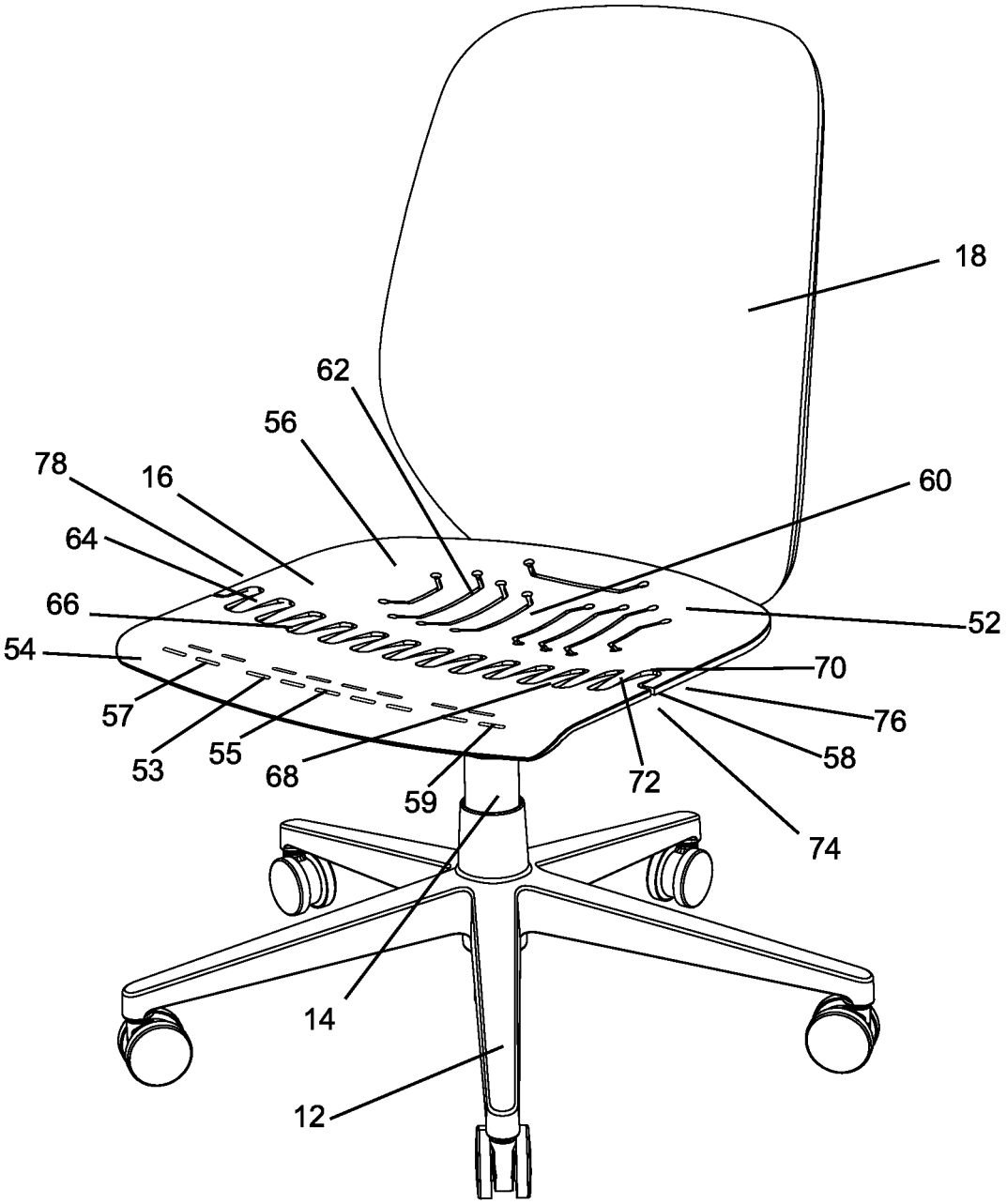
FIG. 11 is a front perspective view of the chair according to one embodiment with the seat upholstery removed.
Figure 12:
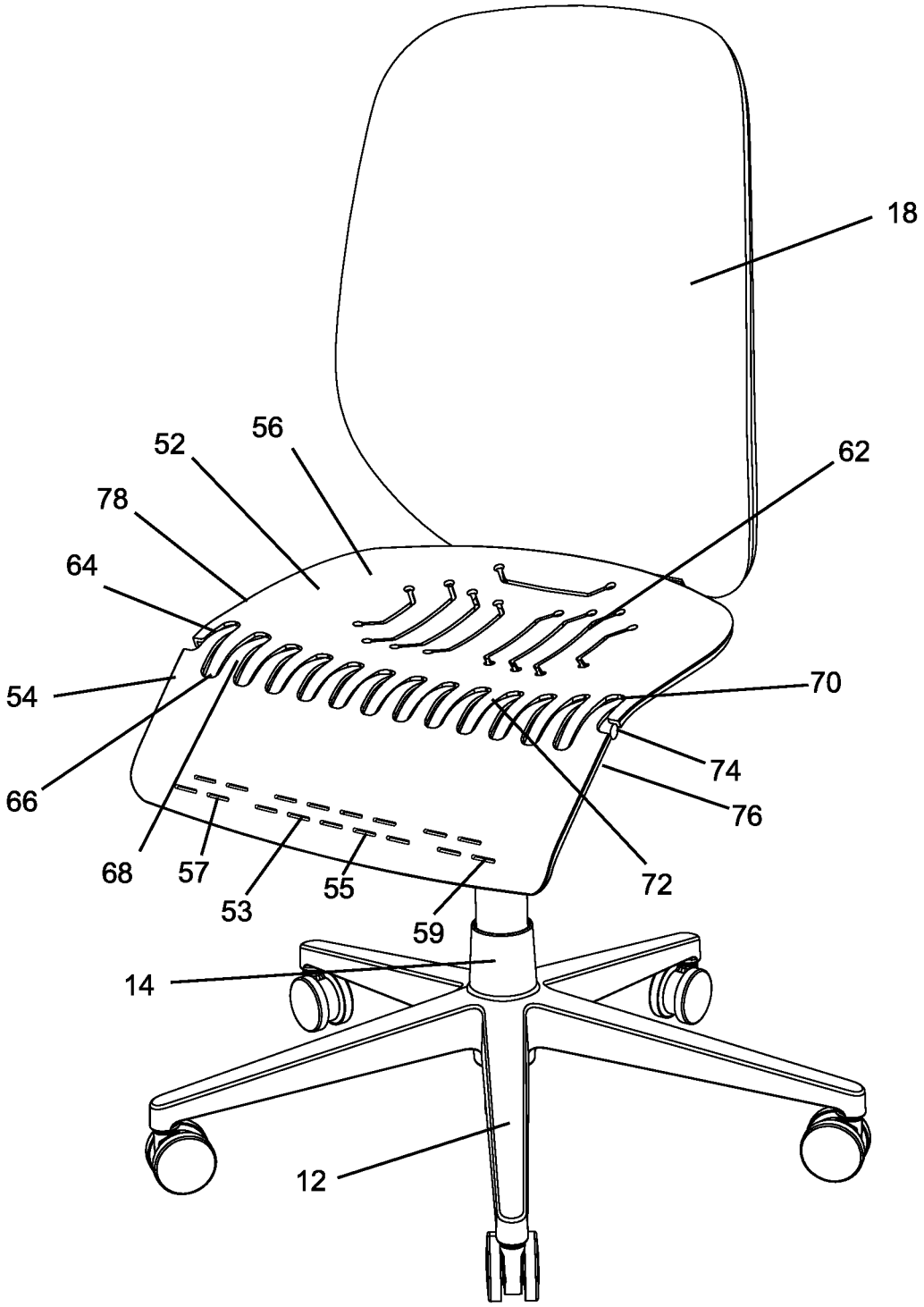
FIG. 12 is a front perspective view thereof with the chair in the elevated ergonomic position.

Referring now to FIGS. 11-12, the seat assembly 16 is shown with the cushioned upholstery removed, exposing a seat pan 52. In the illustrated embodiment, the seat pan 52 is designed for use with the chair 10 in both the lowered and the elevated positions. The seat pan 52 includes a front portion 54 associated with the front portion 34 of the seat assembly and a rear portion 56 associated with the rear portion 36 of the seat assembly 16. The front portion 54 is configured to pivot or flex with respect to the rear portion 56 to enable the front portion 34 of the seat assembly 16 to pivot with respect to the rear portion 36 as noted above. In one embodiment, the front portion 54 and rear portion 56 of the seat pan pivot about a lateral axis 58 between the front 54 and rear 56 portions (and likewise the front 34 and rear 36 portions of the seat assembly 16 pivot about the lateral axis 58, which is generally aligned with pivot point 92. The location of the lateral pivot axis 58 may be selected to promote flexing of the seat assembly 16 at a desired location, such as a desired distance between the user's thighs and ischial tuberosities. In one embodiment, the lateral axis 58 is positioned about six inches forward of the pocket 60 such that the lateral pivot axis 58 is positioned about 6 inches forward of the user's ischial tuberosities, creating a comfortable experience for the majority of users.

As shown in FIGS. 11 and 12, at least a portion of the rear portion 56 of the seat pan may be concave, forming a recess or "pocket" 60 for receiving the ischial tuberosities of the user. In one embodiment, the pocket 60 may be provided with a series of slots 62 extending through the seat pan 52 to provide the seat pan 52 with increased flexibility in the area of the pocket 60. In another embodiment, also shown in FIGS. 11 and 12, the seat pan 52 includes a series of slots 53 in the front portion 54 of the seat pan 52 which increase flexibility of the seat pan in the locations of the slots and thus act to relieve stress on the rear of the user's thighs. The size and locations of these slots 53 may be predetermined to relieve stress in desired locations. In the illustrated embodiment, the slots 53 include a central group 55, a left side group 57 and a right side group 59.

Although various methods may be used for creating the pivot or flexing of the seat pan 52, the illustrated embodiment shows one such method that enables flexing while reducing stress on the user. As shown in FIGS. 11 and 12, in this embodiment, the front 54 and rear 56 portions of the seat pan 52 cooperate to form a bridge 64 therebetween. In particular, the rear edge 66 of the front portion 54 includes a series of spaced apart flexible fingers 68 extending outwardly therefrom. Similarly, the forward edge 70 of the rear portion 56 includes a separate series of spaced apart flexible fingers 72. The fingers 68, 72 interlock with each other, with the fingers 68 extending into the gaps between the fingers 72 and underneath the forward edge 70 of the rear portion, and with the fingers 72 extending into the gaps between the fingers 68 and underneath the rear edge 66 of the front portion 54. As shown in FIG. 12, each of the fingers 68, 72 flexes and slides with respect to the opposite adjacent finger 68, 72 as the seat assembly 16 is moved to the elevated position, providing the bridge 64 with a smoothly rounded surface at the location of the lateral axis 58. In one embodiment, the bridge 64 includes hinges 74 at the lateral edges 76, 78 of the seat pan 52 interconnecting the front 54 and rear 56 portions of the seat pan 52. The characteristics of the bridge, such as the amount of curvature of the bridge 64 and the degree of flexibility of the bridge 64 can be controlled by varying the characteristics of the fingers 68, 72.

The chair 10 includes a mechanism for connecting the pedestal 14 (or, in another embodiment, the base 12) to the seat assembly 16 in order to enable the movement of the seat assembly 16 between the lowered position and the elevated ergonomic position. In the illustrated embodiment, this mechanism is a linkage mechanism 20 connected between the pedestal 14 and the seat assembly 16. As shown, the linkage mechanism 20 includes a pair of first link arms 80, a pair of second link arms 82 and an assist device 83. The first 80 and second 82 pairs of link arms collectively form a four-bar linkage. The first pair of link arms 80 extend from a central portion of the upper pedestal 30 to the rear edge 42 of the rear portion 36 of the seat assembly 16. The forward ends 84 of the link arms 80 pivot with respect to the pedestal 14 and the rear ends 86 of the link arms 80 pivot with respect to the seat assembly 16. The second pair of link arms 82 extend between the forward edge 33 of the upper pedestal 30 and the front edge 44 of the front portion 34. The second link arms 82 each include a forward end 90 pivotally connected to the pedestal 14 (and aligned with the pivot axis 48) and a rear end 92 pivotally connected to the seat assembly 16. In the illustrated embodiment, these second link arms 82 are integrated with the lateral sides 76, 78 of the seat pan 52, but they may alternatively be separate from the seat assembly 16. In one embodiment, the second link arms 82 are shorter than the first link arms 80. The arms 80, 82 can collectively be pivoted between a first position, in which they are generally horizontal, to a second position, in which they are angled upwardly. During pivoting of the link arms, the rear ends 86, 92 of the link arms move in a continuous arcuate motion that drives the seat assembly 16 from the lower position to the elevated ergonomic position. The lengths and locations of the link arms 80, 82 are thus predetermined to provide the seat assembly with the desired positioning for both positions. For reference, FIGS. 3 and 4 symbolically illustrate (with crosshairs) the locations of the front end 90 of the link arm 82, the rear end 92 of the link arm 82, the front end 84 of the link arm 80 and the rear end 86 of the link arm 80. These four crosshair locations form the pivot points for the four bar linkage 20. Once embodiment of the relative movement of the pivot points 86 and 92 between the two chair posture positions can thus be seen in FIGS. 3 and 4.

The assist device 83 is mounted between a portion of the chair 10 and the seat assembly 16 and can be actuated to assist movement of the link arms 80, 82 and the seat assembly 16 to the elevated ergonomic position. In one embodiment, the assist device 83 is a gas assist cylinder 94 that is mounted between the upper pedestal 30 and the front portion 34 of the seat assembly 16. The cylinder 94 includes a piston 95 that can be actuated to extend and drive the seat assembly 16 to the elevated position. An activation lever 96 is connected to the cylinder 94, and can be pulled by the user to actuate the piston 95. In one embodiment, the assist device 83 is provided with sufficient force to move an unoccupied chair 10 from the lowered position to the elevated position, but insufficient to move an occupied chair 10. As a result, a user must change from a static posture to a dynamic posture when activating the chair 10 to move it to the elevated position. In an alternative embodiment, the assist device 83 may be a hydraulic cylinder, electric drive, or another mechanism for assisting movement of the seat assembly 16.

Figure 13:
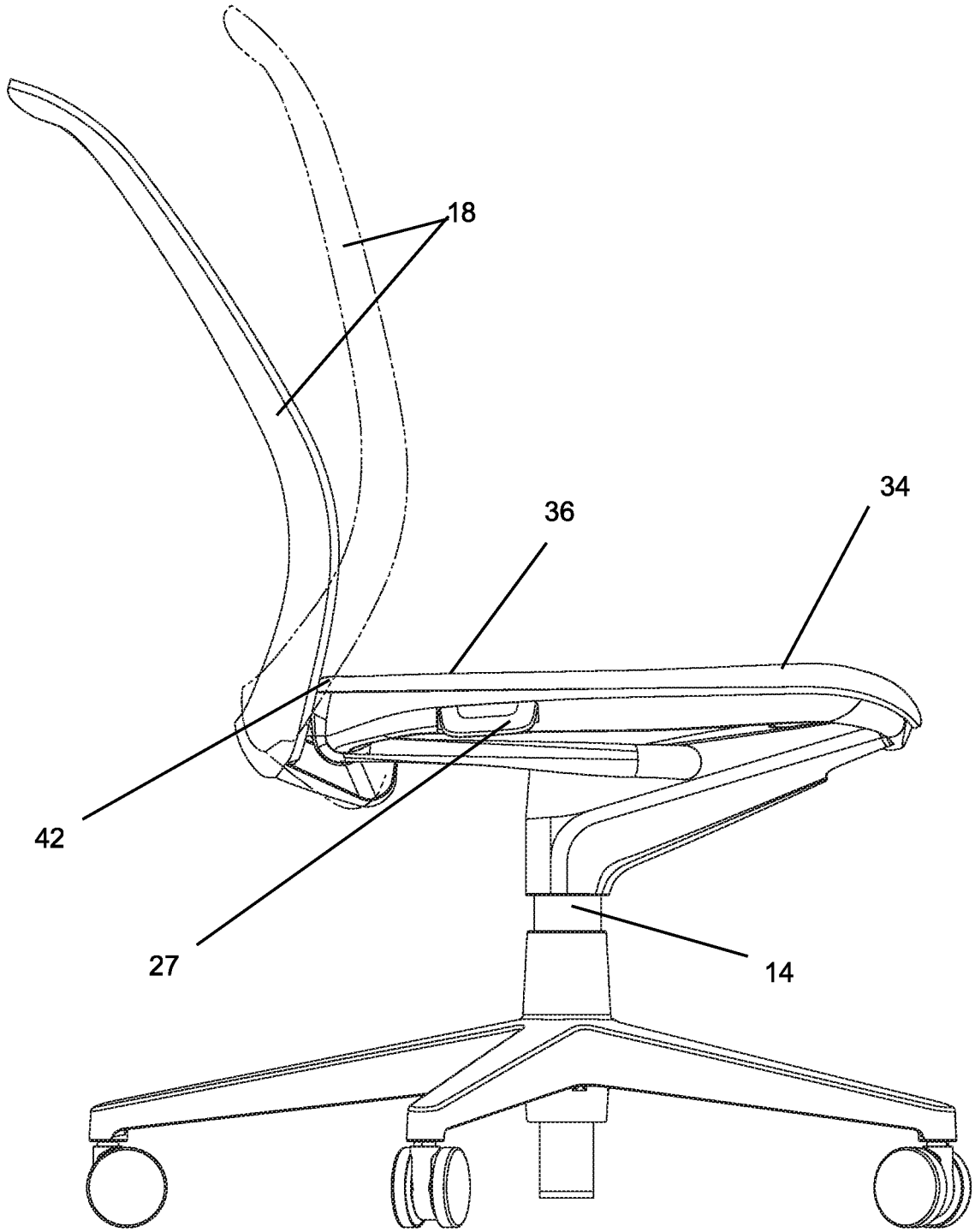
FIG. 13 is a side view of the chair according to one embodiment with a back support shown in upright and reclined positions.
Figure 14:
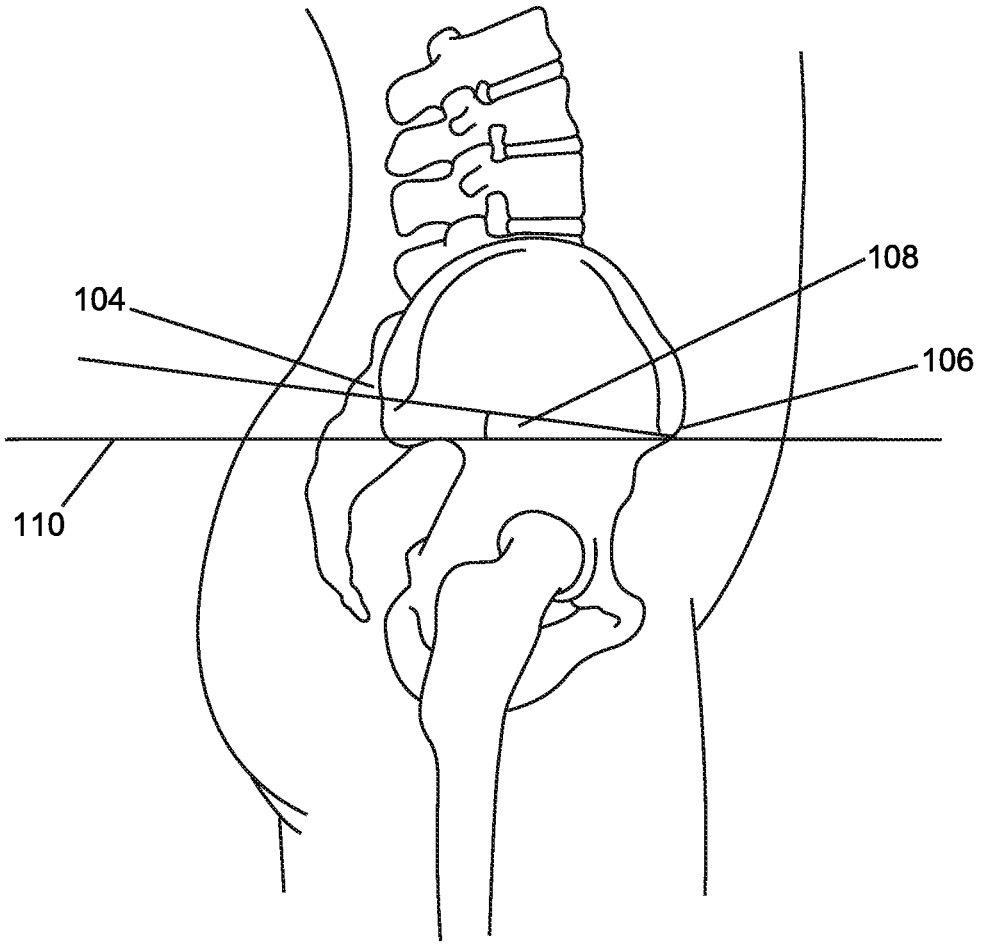
FIG. 14 is a schematic side view of a user's lumbar spine and pelvis.

Referring now to FIG. 13, the backrest 18 extends upwardly from the seat assembly 16. As shown, the backrest 18 is connected to the rear edge 42 of the rear portion 36 of the seat assembly 16. As a result, the backrest 18 moves with the rear portion 36 as the rear portion is moved between the lowered position and the elevated ergonomic position. In one embodiment, the backrest 18 includes a recline mechanism and is capable of reclining as shown in FIG. 13 from an upright position shown in broken lines to a reclined position shown in solid lines. The recline mechanism may be operable by the user in both the lowered position of the seat assembly and in the elevated position.

FIGS. 3 and 4 show a schematic version of an occupant 99 sitting in the chair 10 in order to illustrate the posture of the user, and the change in posture of the user, between the lowered position of the chair 10 shown in FIG. 3 and the elevated ergonomic position of the chair 10 shown in FIG. 4. The position of the seat assembly 16 in the elevated ergonomic position is predetermined to position the occupant or user 99 in a neutral posture. In particular, the forward tilt of the upper surface 40 of the rear portion 36, and the angle between the upper surfaces 38, 40 of the front 34 and rear 36 portions of the seat assembly 16 are predetermined to promote a neutral posture. The relative angles and positions of the front 34 and rear 36 portions promote a neutral posture for the occupant 99. FIGS. 3 and 4 show a body centered vertical reference line 98 taken along the lateral midline of the torso using the center of the shoulder joint as reference. A midline of the thigh 100 is also shown, which is aligned with the lateral midline of the femur, using the center of the knee joint as reference. The angle 102 between these two lines is a thigh-torso angle, and as noted above is an important measure of neutral posture. As shown in FIG. 3, in the lowered position of the chair 10 (the general position of a standard task chair), the thigh-torso angle 102 is approximately between 90-100 degrees. As shown in FIG. 4, when the chair 10 has been moved to the elevated ergonomic position, the thigh-torso angle 102 is increased to about 128 degrees, within the accepted range for a neutral posture and thus providing the associated advantages for the user. This is generally attributed to the combination of the forward tilt of the upper surface 40 of the rear portion 36, and the downward angle of the front seat assembly portion 34 with respect to the rear portion 36. The forward tilt of the rear portion 36 acts to rotate the pelvis forward to keep the user's posterior superior iliac spine (PSIS) higher than the user's anterior superior iliac spine (ASIS). The downward angle of the front seat assembly portion 34, acts to relieve stress on the user's thigh and enables opening up of the thigh-torso angle 102. Importantly, the elevated ergonomic position promotes a neutral posture without pulling the user away from the worksurface. In addition, the upper surface 40 of the rear seat assembly 36—and the ischial pocket 60—support the primary weight of the user even with the chair 10 in the elevated position, reducing stress and fatigue caused by standing. Finally, in the elevated ergonomic position, the rear portion 36 of the seat assembly 16 is generally aligned above the lower portion 28 of the pedestal, aligning the user's center of gravity above the center of the base to keep the chair stable in the elevated position.

Operation of the chair 10 according to one embodiment includes one or more of the steps of: (a) rolling the chair 10 to a desired position using the casters 26 (in an office environment, the desired position will generally be adjacent a worksurface); (b) sitting in the chair 10 with the chair in the lowered position, wherein the upper surfaces 38, 40 of the front 34 and rear 36 portions of the seat assembly 16 are generally aligned to form a planar seating surface; (c) adjusting the height of the seat assembly 16 to a desired position by pulling the lever 27 to actuate the height adjustment mechanism; and (d) moving the seat assembly 16 from the lowered position to the elevated ergonomic position by pulling the activation lever 96 to activate the assist cylinder 94 while the user stands slightly to enable the chair to move to the elevated ergonomic position, thereby changing the user from a static posture to a dynamic posture. When in the elevated ergonomic position, the user may release the lever 96 to lock the seat assembly 16 in the elevated position such that the user may sit on the upper surface 40 of the rear portion 36 of the seat assembly 16. In one embodiment, the seat assembly 16 locks in only the lowered position and the predetermined elevated ergonomic position in order to promote the neutral posture of the elevated ergonomic position and prevent the user from positioning the chair in a less ergonomic position. However, in an alternative embodiment the chair 10 may be configured such that the user may release the level to also lock the chair 10 in any position between the lowered position and the elevated position.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Features of various embodiments may be used in combination with features from other embodiments. Directional terms, such as "vertical," "horizontal," "top," "bottom," "front," "rear," "upper," "lower," "inner," "inwardly," "outer," "outwardly," "forward," and "rearward" are used to assist in describing the invention based on the orientation of the embodiments shown in the illustrations. The use of directional terms should not be interpreted to limit the invention to any specific orientation(s). Any reference to claim elements in the singular, for example, using the articles "a," "an," "the" or "said," is not to be construed as limiting the element to the singular.

The embodiments of the invention in which an exclusive property or privilege is claimed are defined as follows:

1. An office-type chair comprising;

a base;

a height-adjustable pedestal extending upward from the base;

a seat assembly including a rear seat part pivotally connected to a front seat part at a laterally extending axis and a seat pan comprising a rear portion supporting the rear seat part and a front portion supporting the front seat part, wherein the front portion and the rear portion are interconnected by a bridge formed of a front series of flexible projections on a rear edge of the front portion and a rear series of flexible projections on a front edge of the rear portion, wherein the front and rear series of projections flexingly and slidably engage each other in an interleaving arrangement to form a smoothly transitioning contoured surface about the laterally extending axis when the first and second seat parts are pivoted relative to each other; and a linkage system connecting the pedestal to the seat assembly, wherein the linkage system is adapted to pivot the seat assembly between a first generally planar horizontal position of the front and rear seat parts to serve as a task chair and a second more upward and forwardly non-planar angled position of the front and rear seat parts to serve as an elevated sitting support.

2. The chair according to claim 1 comprising a backrest arrangement including a recline mechanism and backrest support, the backrest support extending upwardly from the seat assembly for supporting the back of a user in the first and second positions, wherein the recline mechanism is connected to the rear seat part of the seat assembly and the backrest support rotates with respect to the recline mechanism.

3. The chair according to claim 1 wherein the base includes multiple support arms with non-locking casters.

4. The chair according to claim 1 wherein the linkage system includes support arms that articulate in a continuous motion path between a first normally seated posture position and a second more elevated sitting posture position.

5. The chair according to claim 1 wherein the bridge between the front seat part and the rear seat part is positioned a distance adapted to be approximately 6" forward of and occupant's ischial tuberosity bones.

6. The chair according to claim 4 wherein in the first position of the seat assembly the front and rear seat parts are both generally horizontally oriented such that they are in line with each other at approximately 3.5 degrees rearward tilt.

7. The chair according to claim 4 wherein in the second position the rear seat part is about 5 degree forward tilt.

8. The chair according to claim 4 wherein in the second position the front seat part is at an approximate 40 degree angle relative to the rear seat part.

9. The chair according to claim 4 wherein in the second position at least a portion of the rear seat part is approximately 5 inches higher than in the first position.

10. The chair according to claim 4 wherein the rear seat part includes a concave portion forming an ischial tuberosity pocket, and wherein in the second position the ischial tuberosity pocket is approximately vertically in line with the center of the height adjustable pedestal.

11. The chair according to claim 4 wherein the linkage system support arms include at least one rear support arm connected to the rear seat part and at least one forward support arm connected to the front seat part, the support arms each having upper ends that move in an arcuate motion between the first and second positions.

12. An office-type chair, comprising:

a base;

a height adjustable pedestal extending upwardly from the base;

a seat assembly supported on the pedestal, the seat assembly including a forward seat surface and a rearward seat surface, the forward seat surface being pivotally connected to the rearward seat surface at a laterally extending axis and a seat pan comprising a rear portion supporting the rear seat surface and a front portion supporting the front seat surface, wherein the front portion and the rear portion are interconnected by a bridge formed of a front series of flexible projections on a rear edge of the front portion and a rear series of flexible projections on a front edge of the rear portion, wherein the front and rear series of projections flexingly and slidably engage each other in an interleaving arrangement to form a smoothly transitioning contoured surface about the laterally extending axis when the first and second seat parts are pivoted relative to each other; and a linkage assembly supporting the seat assembly, the linkage assembly including a rear portion connected to the rear seat surface, a forward portion connected to the forward seat surface, and an assist portion, the linkage assembly movable between a lowered position and an elevated position, wherein in the lowered position the forward seat surface and the rearward seat surface are generally aligned in a seating plane, and wherein in the elevated position the rearward seat portion is elevated above its position in the lowered position and the forward seat surface is pivoted at an angle with respect to the rearward seat portion, the forward seat surface extending at a downward angle from the rearward seat portion to reduce stress on the thigh of a user, wherein the assist portion can be actuated by the user to assist the movement of the seat assembly to the elevated position.

13. The chair according to claim 12 wherein in the second position the rear seat part is about 5 degree forward tilt.

14. The chair according to claim 13 wherein in the elevated position the front seat surface is at an approximate 40 degree angle relative to the rear seat surface.

15. The chair according to claim 13 wherein the chair includes a backrest support extending at a backrest angle from the seat assembly, and where the movement of the seat assembly from the lowered position neither increases nor decreases the backrest angle.

16. The chair according to claim 13 wherein the change in angle of the rear seat part from the lowered position to the elevated position is between approximately 8-10 degrees.

17. An office-type chair, comprising:

a base;

a height adjustable pedestal extending upwardly from the base; and a seat assembly supported on the pedestal, the seat assembly including a forward seat surface and a rearward seat surface, the forward seat surface being pivotally connected to the rearward seat surface at a laterally extending axis, and a seat pan comprising a rear portion supporting the rear seat surface and a front portion supporting the front seat surface, wherein the front portion and the rear portion are interconnected by a bridge formed of a front series of flexible projections on a rear edge of the front portion and a rear series of flexible projections on a front edge of the rear portion, wherein the front and rear series of projections flexingly and slidably engage each other in an interleaving arrangement to form a smoothly transitioning contoured surface about the laterally extending axis when the first and second seat parts are pivoted relative to each other, wherein the seat assembly is movable between a lowered position and an elevated position, wherein in the lowered position the forward seat surface and the rearward seat surface are generally aligned in a seating plane, and wherein in the elevated position the rearward seat surface is elevated above its position in the lowered position and the forward seat surface is pivoted at a downward angle with respect to the rearward seat portion.

18. The chair according to claim 17 comprising a backrest arrangement connected to the rearward seat surface, the backrest arrangement including a back support extending upwardly from the seat assembly and a recline mechanism, the backrest arrangement moving with the rearward seat surface between the lowered position and the elevated position, the back support pivoting about the recline mechanism with respect to the rearward seat surface.

19. The chair according to claim 17 wherein the change in angle of the rear seat part from the lowered position to the elevated position is between about 8-10 degrees and the change in angle of the front seat part with respect to the rear seat part is about 40 degrees thereby adapted to promote a neutral posture of a user such that the user's thigh to torso angle is between about 121 and 135 degrees and the user's posterior superior iliac spine (PSIS) is located higher than the user's anterior superior iliac spine (ASIS).

20. The chair according to claim 19 wherein the bridge between the front seat part and rear seat part is positioned a distance adapted to be approximately 6" forward of the user's ischial tuberosity bones.

* * * * *